US012543805B2

(12) United States Patent
Nibhanipudi

(10) Patent No.: US 12,543,805 B2
(45) Date of Patent: Feb. 10, 2026

(54) METHOD FOR PROPHYLACTIC MANAGEMENT OF AN IMMUNOCOMPROMISED PATIENT USING A FACE MASK WITH MINI EXHAUST FAN

(71) Applicant: Kumara V. Nibhanipudi, Scarsdale, NY (US)

(72) Inventor: Kumara V. Nibhanipudi, Scarsdale, NY (US)

( * ) Notice: Subject to any disclaimer, the term of this patent is extended or adjusted under 35 U.S.C. 154(b) by 0 days.

(21) Appl. No.: 18/772,372

(22) Filed: Jul. 15, 2024

(65) Prior Publication Data

US 2026/0013579 A1 Jan. 15, 2026

(51) Int. Cl.
*A41D 13/11* (2006.01)
*A41D 13/002* (2006.01)

(52) U.S. Cl.
CPC ..... *A41D 13/11* (2013.01); *A41D 13/0025* (2013.01)

(58) Field of Classification Search
CPC .. A41D 13/00; A41D 13/002; A41D 13/0025; A41D 13/11; A41D 13/1161; A62B 18/006; A62B 18/025; A62B 18/08; A62B 18/084; A62B 9/00; A62B 7/00; A62B 7/10; A61L 9/16; A61L 9/20; A61L 9/122
See application file for complete search history.

(56) References Cited

U.S. PATENT DOCUMENTS

| | | | | |
|---|---|---|---|---|
| 11,135,458 | B1 * | 10/2021 | Nibhanipudi | A62B 23/02 |
| 2014/0312691 | A1 * | 10/2014 | Doljack | H02J 7/0036 307/29 |
| 2015/0202473 | A1 * | 7/2015 | Curran | A62B 23/025 128/205.27 |
| 2021/0274876 | A1 * | 9/2021 | Conrad | A62B 18/025 |
| 2022/0008757 | A1 * | 1/2022 | Lawlor | A62B 7/10 |
| 2022/0054867 | A1 * | 2/2022 | Adams | B01D 46/0086 |
| 2022/0305302 | A1 * | 9/2022 | Hall | A62B 18/006 |
| 2022/0307708 | A1 * | 9/2022 | Cha | F24F 8/108 |

* cited by examiner

*Primary Examiner* — Alireza Nia
*Assistant Examiner* — Gina Mccarthy
(74) *Attorney, Agent, or Firm* — MaxGoLaw PLLC

(57) ABSTRACT

A method of prophylactic management of an immunocompromised patient with a mask having a fan assembly is provided. The method includes the mask being fitted to a face and covering a nose and mouth of the patient. The mask is secured to a head of the patient with a set of fasteners. The fan assembly is activated with a power supply to exhaust air from the mask at a rate of at least 5 liters per minute of air flow and dispel particulate matter to inhibit pathogens being inhaled by the patient.

9 Claims, 6 Drawing Sheets

(Section A-A)

METHOD FOR PROPHYLACTIC MANAGEMENT OF AN IMMUNOCOMPROMISED PATIENT USING A FACE MASK WITH MINI EXHAUST FAN

FIELD OF THE INVENTION

The present invention in general relates to methods for protecting immunocompromised patients from pathogens with personal protective equipment and in particular to a method for limiting pathogen exposure for immunocompromised patients with a face mask with an exhaust fan for dispelling contaminants from the surface of the mask to promote natural function of pulmonary cilia.

BACKGROUND OF THE INVENTION

Immunocompromised refers to an impaired or weakened immune system. People who have an impaired or weakened immune system have a greatly reduce ability to fight off infectious diseases, viruses, bacteria, or fungi, and have a heightened susceptibility to serious infections, respiratory infections, pneumonia, diseases, and other debilitations and etiologies that can pose a major health risk. A compromised immune system may be a genetic condition or a condition of an infection or disease, but is also associated people who have cancer and are on chemotherapy, undergoing bone marrow transplants, or who have had a solid organ transplant, including a kidney transplant or heart transplant, and are taking medication to keep their transplant from being rejected from the patient's own immune system.

Furthermore, certain conditions, such as HIV and AIDS, destroy immune cells, leaving the body vulnerable to other attacks. Autoimmune conditions turn immune cells into double agents that fight against a person's healthy tissues. Common autoimmune diseases include: lupus, rheumatoid arthritis, and type 1 diabetes. Conditions like asthma can also affect the immune system because they cause the immune system to dangerously overreact to harmless substances. Cancers such as leukemia or lymphoma are also diseases of the immune system as they are white blood cell diseases, and white blood cells are needed to respond to infections.

Patient's or people with compromised immune systems are often advised to wear facemasks to avoid inhaling airborne agents that may pose a risk to them. However, most common medical facemasks, illustratively including N93, N95, KN95, FFP2, P2, DS, nebulizer, or other face masks, as well as non-conventional face masks, have an inherent problem of organisms settling on the outer surface of any of these face masks and the organisms continuing to their respective dwellings in the patient. A prior art nebulizer mask is shown in FIG. 1.

U.S. Pat. No. 11,135,458 issued Oct. 5, 2021 to the inventor and incorporated herein by reference in its entirety provides embodiments of masks that include a shell with an aperture with a fan assembly positioned in the aperture and secured to the shell. The exhaust fan functions to dispel contaminants from the surface of the mask.

FIG. 2 and FIG. 3 illustrate an embodiment of a facial mask 10 as disclosed in U.S. Pat. No. 11,135,458 equipped with a fan 16. The shell 12 of the mask 10 is made of a one or more materials that maintain the shape of hemispherical or ovoid (oblong hemispherical) shapes that also supports an attached fan assembly 16. Materials that form the shell 12 illustratively include one or more of plastic, woven or spun fibers, and corrugated material. The fan assembly 16 fits in an aperture 14 formed in the shell 12. The fan assembly 16 includes a hub 18 with a set of blades 20 attached thereto. In embodiments, the number of fan blades 20 varies between 2 and 6. It is appreciated that the number of fan blades may be more than six. The hub 18 houses a motor 30 powered by a power source 32. The motor 30 rotates the blades 20 in a direction that generally exhausts air away from the face of the wearer depending on the orientation of the blades 20. The power source 32 may be a single use battery or a rechargeable battery depending on whether the mask 10 is designed for single use or is a reusable mask. The fan assembly 16 is attached to the shell 12 by a cage 22 that attaches to the hub 18. A switch 24 controls the motion of the fan assembly 16. In embodiments the fan maybe a single speed or an adjustable variable speed fan controlled by the switch 24. In the event of a rechargeable battery for the power source 32, a recharging port 26 is provided that connects to a removable charging cable 34. A set of fasteners 28 secure the mask 10 to the head of a user. It is appreciated that the set of fasteners 28 may be elastic straps that fit about the ears of the wearer, a set of tie strings, or hook and loop (Velcro®) straps. A removable cap 35 may fit over the cage 22 to protect a user from fan blade motion, while in other embodiments, seal the mask when required to protect the wearer from contagions. The removable cap 35 in some embodiments includes a size exclusion filter 37 to preclude transmission of particles of a desired size range. To the extent that the mask 12 is a conventional mask per prior art FIG. 1, plugs 37, 37' cap the opposing holes 39, 39'. In some embodiments, a sterilizing device 36 is provided that functions to deactivate pathogens. The sterilizing device 36 illustratively includes an ultraviolet light emitting light emitting diode (LED), an electrostatic precipitator, an ozone generator, or combinations thereof. As best shown in FIG. 3, in a specific embodiment the fan assembly is positioned such that the blades 20 of the fan protrude both below and above the outer surface of the shell 12 in order to exhaust air away from the face of the user, as well as, to dispel particulate matter from the outer surface of the shell 12.

FIGS. 4 to 6 illustrate an alternative embodiment as disclosed in U.S. Pat. No. 11,135,458. As shown in FIGS. 4 to 6, a wide aperture 42 was made through the external surface of a face mask 40 in the lower one third region of the mask 40 using a scalpel. In the embodiment shown, the aperture 42 measured horizontal 3 inches and vertical 2 and ¼th inches so that the base of the fan assembly 16 can be positioned in the lower inner portion of the face mask 40. In a specific embodiment the face mask 40 may be a nebulizer face mask in the manner shown in FIG. 1 that may be constructed of polyethylene. The bottom partially detached portion of the cut portion forms a flap 44 that may be used for additional support of the fan assembly 16 that is joined to a modular fan support 46. Half of the hub 18 of the fan assembly 16 is inside the lower face mask and the other half of the hub 18 is outside the face mask along with its attached fan blades 20. The modular fan support 46 has a switch 24 to operate the fan assembly 16 with a rechargeable battery and a recharging port 26 for attachment of a recharging cable 34 for recharging the battery. Securements 48 adhere the modular fan support 46 to the face mask 40. In specific embodiments the modular fan support 46 is removably connected to the face mask 40 with securements 48.

The advances in cancer care as well as care for other diseases and the continual increase in organ transplants has increased the number of immunocompromised patients that require protection from external pathogens. Recent studies of indoor air quality following the coronavirus pandemic have shown that by limiting the pathogen load to which a subject is exposed, the prospective host for infection is often able to avoid infection through the normal function of pulmonary cilia. Individuals cannot control the air quality of buildings through which they pass and passive filtration masks have met with only limited success in preventing infection.

Thus, there exists a need for improved methods for prophylactic management of an immunocompromised patient using a face mask with mini exhaust as such individuals have limited ability to overcome such an infection.

SUMMARY OF THE INVENTION

A method of prophylactic management of an immunocompromised patient with a mask having a fan assembly is provided. The method includes the mask being fitted to a face and covering a nose and mouth of the patient. The mask is secured to a head of the patient with a set of fasteners. The fan assembly is activated with a power supply to exhaust air from the mask at a rate of at least 5 liters per minute of air flow and dispel particulate matter to inhibit pathogens being inhaled by the patient.

BRIEF DESCRIPTION OF THE DRAWINGS

The subject matter that is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains the preferred embodiments of the invention, together with advantages and features, by way of example with reference to the drawings.

DESCRIPTION OF THE INVENTION

The present invention has utility as a method of using a facial personal protective equipment mask with an exhaust fan for dispelling contaminants from the surface of the mask to prevent infection to a user, especially for immunocompromised individuals. The method of usage of a face mask containing a fan acts to drive out particulate matter before adhering to the face mask and hence minimizes inhalation of bacteria and viruses by a wearer of the face mask. The constant airflow away from the face mask also confers to the wearer an added benefit of not carrying the bacteria and viruses thereon and hence is particularly effective in preventing the community spread of infection to members of the same household and to social contacts. As the risk of infection is a constant threat to an immunocompromised patient, the method of use of the facial personal protective equipment mask with the exhaust fan requires continuous uninterrupted power, and the power supply of the mask is connected to a power source connected to outlet mains of the hospital or residence of the patient. If the patient is being moved the mask will switch to battery operation until the patient is stationary and can reconnect to the outlet mains.

It is to be understood that in instances where a range of values are provided that the range is intended to encompass not only the end point values of the range but also intermediate values of the range as explicitly being included within the range and varying by the last significant figure of the range. By way of example, a recited range of from 1 to 4 is intended to include 1-2, 1-3, 2-4, 3-4, and 1-4.

As used herein a facial personal protective equipment mask or respirator mask includes N93, N95, KN95, FFP2, P2, DS, nebulizer, or other face masks, as well as non-conventional face masks that are equipped with an exhaust fan.

Figure 1:
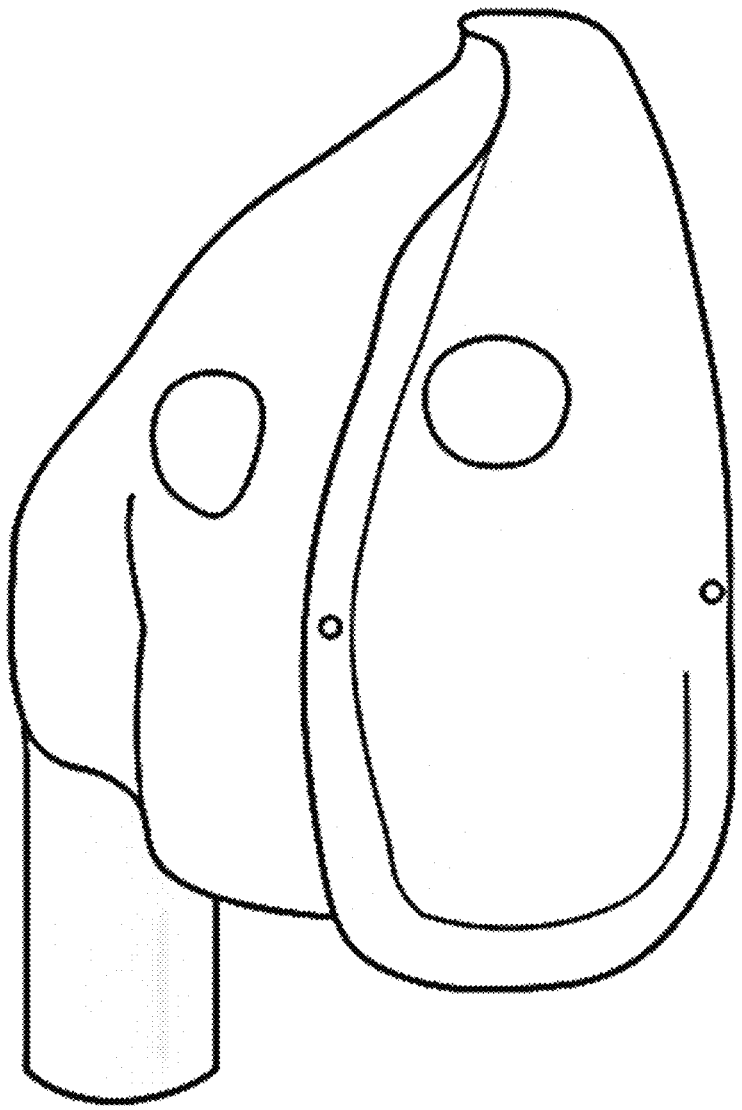
FIG. 1 PRIOR ART
FIG. 1 is a perspective view of a conventional prior art nebulizer mask.
Figure 2:
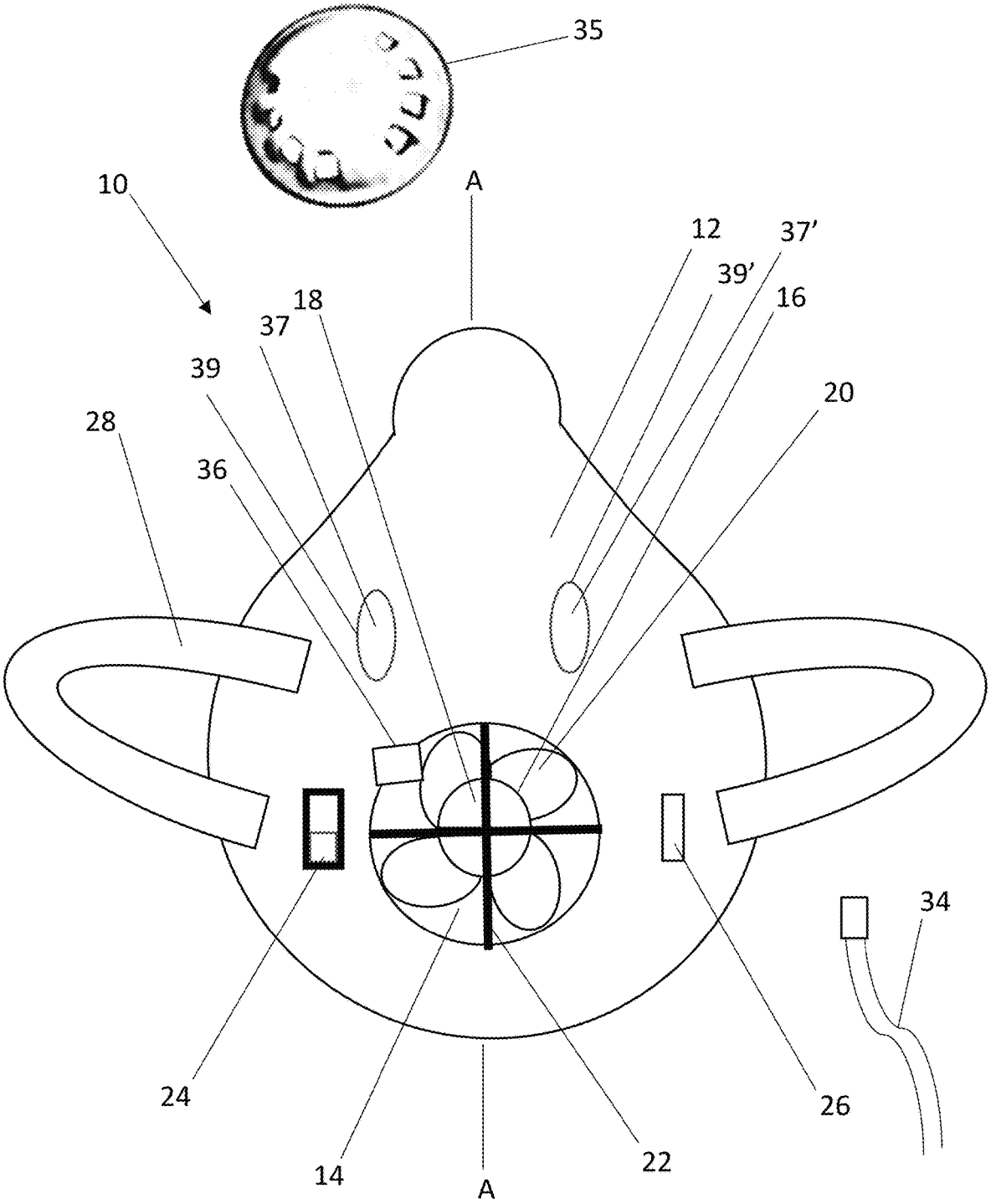
FIG. 2 PRIOR ART
FIG. 2 illustrates a partially exploded frontal view of a facial mask equipped with a fan as disclosed in U.S. Pat. No. 11,135,458.
Figure 3:
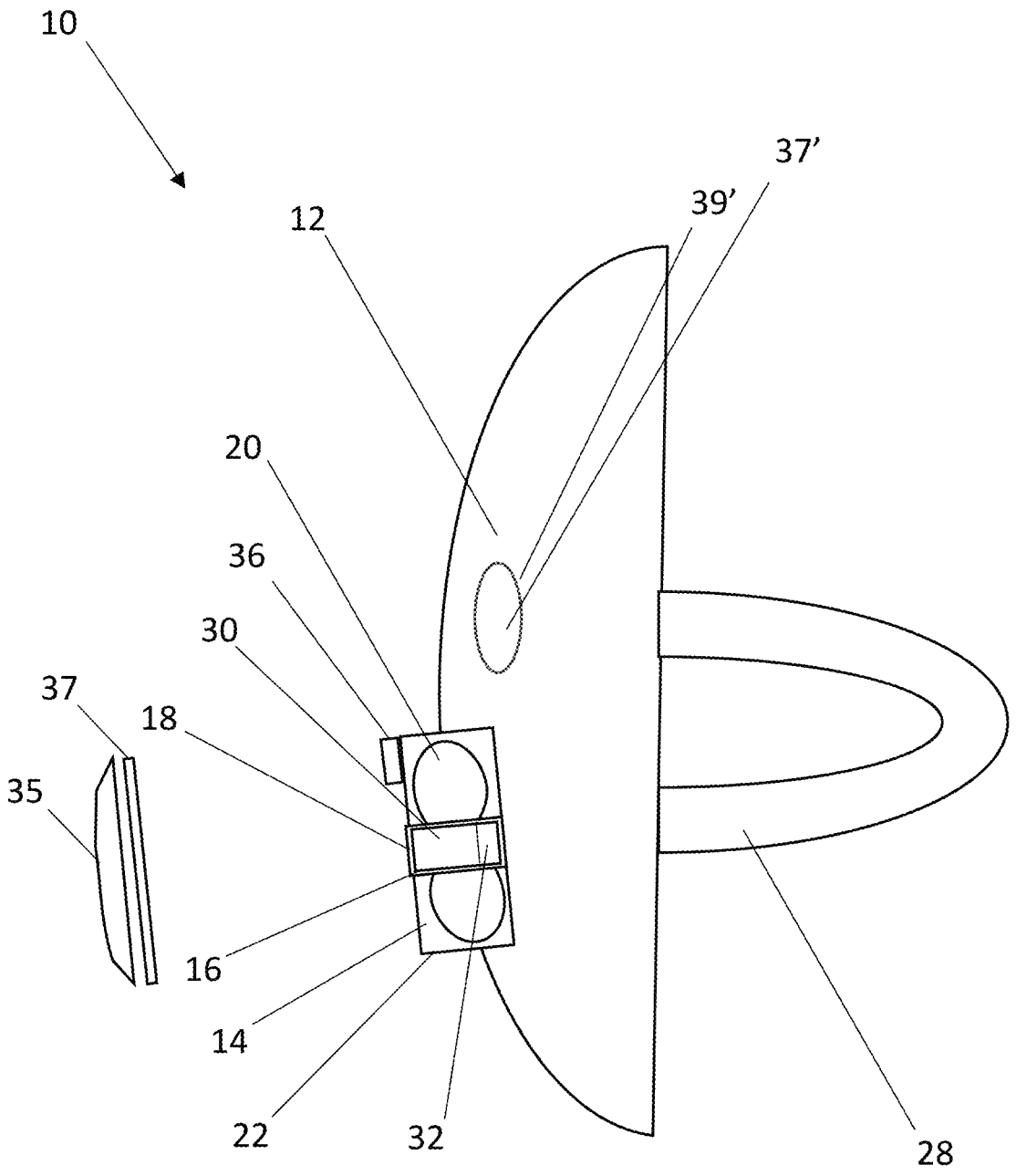
FIG. 3 PRIOR ART
FIG. 3 is a partially exploded side cross sectional view along line A-A of FIG. 2.
Figure 4:
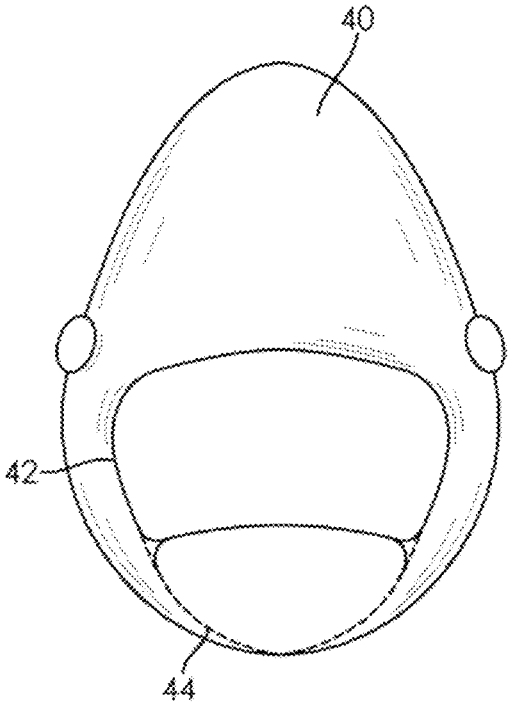
FIG. 4 PRIOR ART
FIG. 4 is a frontal view of a facial mask as disclosed in U.S. Pat. No. 11,135,458 with an aperture cut in the mask to accommodate a fan module.
Figure 5:
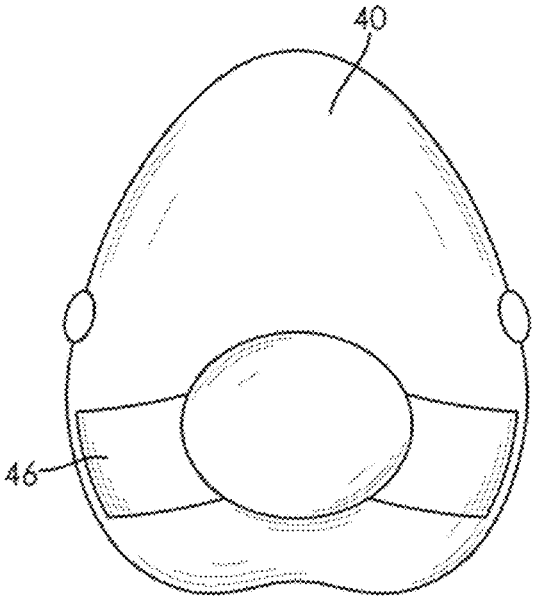
FIG. 5 PRIOR ART
FIG. 5 is a frontal view of a modular fan support connected to the facial mask of FIG. 4.
Figure 6:
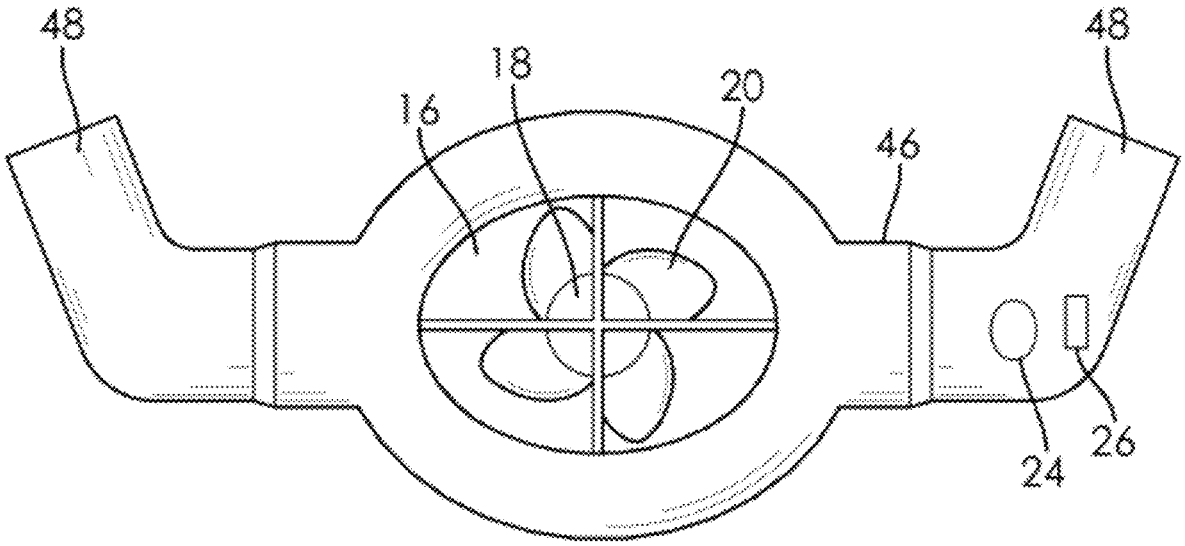
FIG. 6 PRIOR ART
FIG. 6 is a detailed close up of the modular fan support of FIG. 5.
Figure 7:
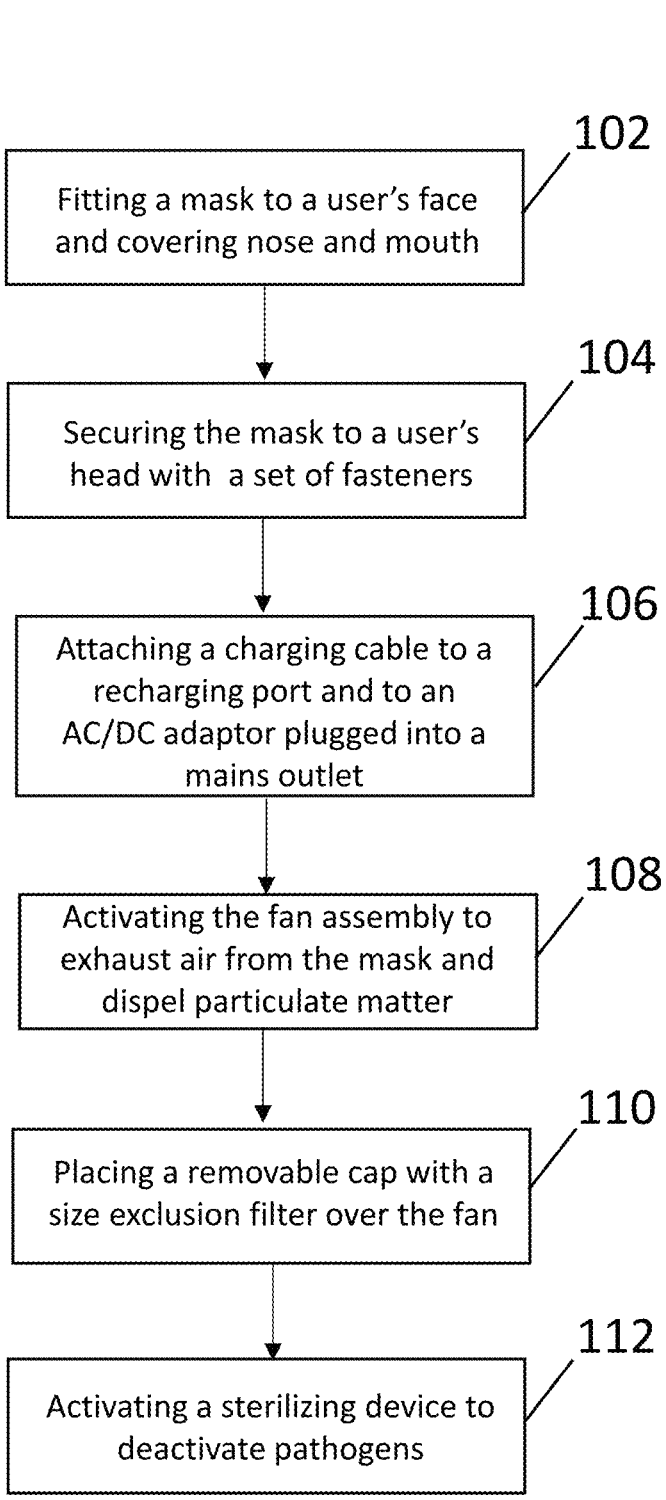
FIG. 7 is a flowchart of an inventive method for using a facial mask equipped with a fan to prevent or mitigate inhalation of infectious agents that may cause harm to immunocompromised individual.

With reference to the figures, FIG. 7 illustrates a flowchart of a method 100 of using an embodiment of a facial mask equipped with a fan to exhaust particulate matter before adhering to the face mask and hence minimizes inhalation of bacteria and viruses by a wearer of the face mask. In the method 100 the mask 10 shown in FIGS. 2 and 3 will be used, although it is appreciated that other embodiments of masks equipped with a fan may be used.

A typical adult breathes between 12 and 20 breaths per minute which corresponds to from 5 to 8 liters of air per minute. An immunocompromised subject, who for example might be in congestive heart failure can breathe between 40 and 60 liters per minute. For the present invention to be effective, it should be worn as much as possible with the proviso that food consumption, imbibing liquids, and hygienic showering are instances when wearing such a mask is difficult. With the intention of near constant wear, critical operational criteria include sufficient air flow to avoid a user from having the perception of insufficient air flow. Other operational parameters to avoid triggering a sense of claustrophobia in a user include excessive operative noise or "droning" and excess heat/humidity within the mask. An inventive method addresses these factors to promote user comfort and therefore regular mask usage.

The method 100 starts by fitting the mask 10 to a user's face and covering the nose and mouth and not the eyes. The mask 10 is fitted to the user's face so as to not allow air to seep between the contact points along the edges of the mask 10 contacting the user's face (Block 102). Securing the mask 10 to the head of the user (Block 104) with the set of fasteners 28. The mask fan is activated through moving a switch to an "ON" position to provide electrical communication between the power source 32 and the motor 30. The fan is sized and operating at a lowest setting to provide 5 liters of air per minute of throughput. In some inventive embodiments, the motor speed is adjustable to variably provide between 5 and 100 liters per minute of air flow. A manual selector is provided on switch 24 to provide various airflows. For example, a "LOW" setting might deliver 5 liters per minute, while "MEDIUM" and "HIGH" setting deliver 20 and 40 liters per minute, respectively. In still other embodiments, the motor is BLUETOOTH® (Bluetooth SIG, Inc.) interfaced to a smart phone, tablet device, or similar device to allow a user to control fan speed and therefore air flow through the electronic interface.

In order to preclude excessive fan noise, in some inventive embodiments, the mask is fitted with a noise-cancelling speaker that emits sound out of phase with the sound made by the motor as part of an inventive mask. In some inventive embodiments, the noise cancellation is only in one dimension and based on the proximity to the user's ears, this is often sufficient to limit the operational noise of the mask. It is appreciated that the energy consumption of the noise-cancelling speaker or several such speakers is negligible compared to the motor 30.

In order to address, user stress associated with wearing a mask when the air is perceived to be humid/hot, a removable cap 35 or a size exclusion filter 37 includes a volume of hygroscopic material, desiccant material, or combination thereof is provided in line with the air flow. Such materials are known to provide passive cooling as detailed in A. R. Rempel et al. Geosciences 2016, 6(3), 38. Active cooling with, for example, a Pelletier air conditioner is disfavored in the context of the present invention owing to the high amperage usage of such devices that have a deleterious effect on battery life, or alternatively, an increase in mask weight associated with additional batteries present in the power source 32.

When the power source is depleted or exhausted, one attaches the charging cable 34 to the recharging port 26 and to an alternating current (AC)/direct current (DC) conversion adaptor plugged into a mains outlet (Block 106). As noted above, the constant operation of the fan assembly 16 in order to mitigate pathogen load from being inhaled by the user, requires considerable power usage. In some inventive embodiments, a user has two inventive masks and operates one while a second recharges.

The power source 32 is preferably rechargeable lithium batteries. In certain inventive embodiments the batteries have sufficient current to operate the motor 30 for at least six hours to facilitate a user sleeping while wearing the mask.

With the power source charged, the fan assembly 16 is activated (Block 108) to exhaust air from the mask 10 and dispel particulate matter illustratively including viruses and bacteria prior to adhering to the face mask. The fan assembly 16, as noted above, has air flow sufficient to avoid a user having a sensation of inadequate air. Air flow of at least 5 liters per minute are provided by operation of the fan assembly 16. A removable cap 35 is fitted over the cage 22 to protect a user from fan blade motion and seals the mask when required to protect the wearer from contagions (Block 110). The removable cap 35 in some inventive embodiments includes a size exclusion filter 37 to preclude transmission of particles of a desired size range. In some inventive embodiments of the method 100, a sterilizing device 36 is provided and activated (Block 112) that functions to deactivate pathogens. A sterilizing device 36 operative herein illustratively includes an ultraviolet light emitting light emitting diode (LED), an electrostatic precipitator, an ozone generator, or combinations thereof.

The foregoing description is illustrative of particular embodiments of the invention but is not meant to be a limitation upon the practice thereof. The following claims, including all equivalents thereof, are intended to define the scope of the invention.

The invention claimed is:

1. A method of prophylactic management of an immunocompromised patient with a mask having a fan assembly, the method comprising: fitting the mask to a face and covering a nose and mouth of the patient to define an inside of the mask, the mask having a power supply consisting of a cabled connection to a mains outlet and a rechargeable on-mask backup battery; securing the mask to a head of the patient with a set of fasteners; attaching a charging cable to a recharging port of the mask and to an AC/DC adaptor plugged into the mains outlet; placing a removable cap with a size exclusion filter over the fan; activating the fan assembly that is in direct fluid communication with the inside of the mask to only exhaust air from the inside of the mask at a rate of 20 to 100 liters per minute of air flow to create constant airflow away from the inside of the face mask and dispel particulate matter to inhibit pathogens being inhaled by the patient for at least six hours when powered by the rechargeable on-mask backup battery alone; providing noise cancelling sound produced by the fan assembly; passing the air flow through a desiccant or a hygroscopic material in the removable cap; and adjusting the rate of air flow with an interfaced smart phone or tablet.

2. The method of claim 1 further comprising filtering air entering or exhausting from the mask through the size exclusion filter.

3. The method of claim 1 further comprising activating a sterilizing device mounted to the mask to deactivate pathogens.

4. The method of claim 1 further comprising providing a sterilizing device, wherein the sterilizing device is one or more of an ultraviolet light emitting light emitting diode (LED), an electrostatic precipitator, an ozone generator, or combinations thereof.

5. The method of claim 1 wherein when the patient is ambulatory the charging cable is disconnected from a recharging port and battery power takes over operation of the fan assembly.

6. A method of prophylactic management of an immunocompromised patient with a mask having a fan assembly, the method comprising: fitting the mask to a face and covering a nose and mouth of the patient to define an inside of the mask, the mask having a power supply consisting of a cabled connection to a mains outlet and a rechargeable on-mask backup battery; securing the mask to a head of the patient with a set of fasteners; attaching a charging cable to a recharging port of the mask and to an AC/DC adaptor plugged into the mains outlet; placing a removable cap with a size exclusion filter over the fan; activating the fan assembly that is in direct fluid communication with the inside of the mask to only exhaust air from the inside of the mask at a rate of 20 to 100 liters per minute of air flow to create constant airflow away from the inside of the face mask and dispel particulate matter to inhibit pathogens being inhaled by the patient for at least six hours when powered by the rechargeable on-mask backup battery alone; providing noise cancelling sound produced by the fan assembly; and passing the air flow through a desiccant or a hygroscopic material in the removable cap.

7. The method of claim 6 further comprising adjusting the rate of air flow.

8. The method of claim 7 wherein the adjusting is with a multimodal switch in the mask.

9. The method of claim 6 wherein when the patient is ambulatory the charging cable is disconnected from a recharging port and battery power takes over operation of the fan assembly.

* * * * *